US007560867B2

(12) United States Patent
Schwannecke et al.

(10) Patent No.: US 7,560,867 B2
(45) Date of Patent: Jul. 14, 2009

(54) STARTER FOR A GAS DISCHARGE LIGHT SOURCE

(75) Inventors: Joshua K. Schwannecke, Grand Rapids, MI (US); Karlis Veczieds, Caledonia, MI (US); David W. Baarman, Fennville, MI (US)

(73) Assignee: Access Business Group International, LLC, Ada, MI (US)

( * ) Notice: Subject to any disclaimer, the term of this patent is extended or adjusted under 35 U.S.C. 154(b) by 514 days.

(21) Appl. No.: 11/550,216

(22) Filed: Oct. 17, 2006

(65) Prior Publication Data

US 2008/0088240 A1 Apr. 17, 2008

(51) Int. Cl.
*H05B 41/291* (2006.01)

(52) U.S. Cl. ..... 315/94; 315/209 R; 315/307; 315/291; 315/224

(58) Field of Classification Search ..... 315/94, 315/98, 99, 105, 106, 107, 209 R, 224, 291, 315/307, DIG. 5, DIG. 7
See application file for complete search history.

(56) References Cited

U.S. PATENT DOCUMENTS

| | | | | |
|---|---|---|---|---|
| 3,801,860 | A | 4/1974 | King | |
| 4,349,768 | A | 9/1982 | Miller | 315/105 |
| 4,396,866 | A | 8/1983 | Bay et al. | |
| 4,501,994 | A | 2/1985 | Spreadbury | 315/307 |
| 4,523,795 | A | 6/1985 | Johnson et al. | 315/97 |
| 4,587,460 | A | 5/1986 | Murayama et al. | 315/174 |
| 4,749,909 | A | 6/1988 | Smulders | |
| 5,023,521 | A | 6/1991 | Sridharan | 315/290 |
| 5,027,032 | A | 6/1991 | Nilssen | 315/103 |
| 5,070,279 | A | 12/1991 | Garbowicz et al. | 315/289 |
| 5,132,595 | A | 7/1992 | Kulka et al. | 315/106 |
| 5,256,939 | A | 10/1993 | Nilssen | 315/244 |
| 5,424,611 | A | 6/1995 | Moriarty, Jr. | |
| 5,451,841 | A | 9/1995 | Dunn et al. | |
| 5,500,792 | A | 3/1996 | Jeon et al. | |
| 5,578,998 | A | 11/1996 | Kasprowicz | |
| 5,616,992 | A | 4/1997 | Bildgen | |

(Continued)

FOREIGN PATENT DOCUMENTS

| | | | |
|---|---|---|---|
| JP | 08153592 | A | 11/1996 |

(Continued)

OTHER PUBLICATIONS

AN1971 Application Note, ST7LITEO Microcontrolled Ballast, 16pgs., STMicroelectronics.

*Primary Examiner*—Douglas W Owens
*Assistant Examiner*—Ephrem Alemu
(74) *Attorney, Agent, or Firm*—Brinks Hofer Gilson & Lione

(57) ABSTRACT

A starter for a gas discharge light source is configured to measure an initial resistance of one or more filaments of the gas discharge light source, such as a fluorescent light, each time the gas discharge light source is initially powered via a ballast. The starter may initiate a preheat cycle to heat the one or more filaments. The duration of the preheat cycle may be automatically customized by the starter based on the initial resistance and a target hot resistance that is calculated by the starter based on the initial resistance. The duration of the preheat cycle may be automatically customized by the starter to optimize reliability and the life of the gas discharge light source.

25 Claims, 5 Drawing Sheets

U.S. PATENT DOCUMENTS

| | | | | |
|---|---|---|---|---|
| 5,652,481 | A | 7/1997 | Johnson et al. | |
| 5,654,507 | A | 8/1997 | Hicks et al. | |
| 5,705,896 | A | 1/1998 | Choi | |
| 5,726,534 | A | 3/1998 | Seo | |
| 5,751,115 | A | 5/1998 | Jayaraman et al. | |
| 5,825,138 | A | 10/1998 | Diazzi et al. | |
| 5,925,985 | A | 7/1999 | Zeng et al. | |
| 5,925,990 | A | 7/1999 | Crouse et al. | 315/307 |
| 5,939,836 | A | 8/1999 | Mita et al. | |
| 5,945,786 | A | 8/1999 | Jurek | 315/276 |
| 5,959,408 | A | 9/1999 | Steel et al. | |
| 6,008,592 | A | 12/1999 | Ribarich | |
| 6,040,661 | A | 3/2000 | Bogdan | 315/224 |
| 6,081,077 | A * | 6/2000 | Canova et al. | 315/307 |
| 6,121,731 | A | 9/2000 | Kanazawa et al. | |
| 6,232,727 | B1 | 5/2001 | Chee et al. | |
| 6,243,017 | B1 | 6/2001 | Kuisma | |
| 6,300,777 | B1 | 10/2001 | Ribarich | |
| 6,339,299 | B1 | 1/2002 | Wu et al. | |
| 6,348,769 | B1 * | 2/2002 | Pinchuk et al. | 315/291 |
| 6,359,387 | B1 * | 3/2002 | Giannopoulos et al. | 315/94 |
| 6,400,095 | B1 | 6/2002 | Primisser et al. | |
| 6,531,831 | B2 | 3/2003 | Chou et al. | |
| 6,538,448 | B1 | 3/2003 | Tabell | |
| 6,556,017 | B1 | 4/2003 | Pettersson | |
| 6,563,268 | B2 | 5/2003 | Yoshida et al. | 315/73 |
| 6,603,275 | B2 | 8/2003 | Ku | |
| 6,677,719 | B2 | 1/2004 | Ortmeyer, II | |
| 6,750,619 | B2 | 6/2004 | Nemirow et al. | |
| 6,806,649 | B2 | 10/2004 | Mollema et al. | 315/96 |
| 6,822,401 | B2 | 11/2004 | Borella et al. | |
| 6,891,339 | B2 | 5/2005 | Ribarich et al. | |
| 6,963,178 | B1 | 11/2005 | Lev et al. | |
| 2003/0230990 | A1 | 12/2003 | Yang et al. | |
| 2004/0174122 | A1 | 9/2004 | Ribarich | |
| 2004/0232855 | A1 | 11/2004 | Ribarich et al. | |
| 2005/0035729 | A1 | 2/2005 | Lev et al. | |
| 2005/0116650 | A1 * | 6/2005 | Baarman | 313/635 |
| 2005/0156534 | A1 | 7/2005 | Oh | |
| 2005/0168175 | A1 | 8/2005 | Radzinski et al. | |
| 2006/0006814 | A1 | 1/2006 | Wendt et al. | |
| 2006/0214594 | A1 * | 9/2006 | Busse | 315/112 |

FOREIGN PATENT DOCUMENTS

| | | |
|---|---|---|
| JP | 2002/056995 | 2/2002 |
| WO | WO 01/43510 A1 | 6/2001 |

* cited by examiner

STARTER FOR A GAS DISCHARGE LIGHT SOURCE

BACKGROUND OF THE INVENTION

1. Technical Field

The present invention relates to gas discharge light sources, and more particularly to a starter for a gas discharge light source 2. Related Art Lamp starters may be used to start and operate gas discharge lamps. Gas discharge lamps include cathodes that may be filaments disposed inside a gas filled enclosure, such as a tube. The filaments are used to strike an arc in the enclosure to ionize the gas. Once ionized, the gas may form a plasma that generates light energy. Such starters may be formed with one or more electronic components. A lamp starter may be used to control the voltage and current provided to the lamp during startup and operation. Typically, the starter includes a preheat cycle and a start cycle. During the preheat cycle, voltage and current are supplied to the filaments to warm the gas. Once the gas is warmed, a voltage and current may be supplied to the lamp to strike an arc.

The duration of the preheat cycle prior to the operating cycle may be based on a predetermined period of time, based on a resistor with heating characteristics similar to a lamp, or a current or a voltage supplied to the gas discharge lamp. In addition, in one type of preheat circuit, the resistance of a filament of the lamp is determined by measuring a voltage (V) of the filament, and a current (I) through the filament. When the filament is heated to a pre-specified resistance (R=V*I), the preheat cycle is complete and the lamp enters the operating cycle.

An optimal preheat duration maximizes lamp life, however, with all of these types of preheat schemes, the starter uses some form of generic predetermined value of time, voltage, current, or resistance to determine the duration of the preheat cycle. Accordingly, the type of lamp used with the starter must be known and previously tested to determine the generic predetermined time, voltage, current, or resistance value to be used in the preheat cycle. In addition, variations in materials and manufacturing of gas discharge lamps makes the optimal preheat duration of a lamp vary significantly, even among lamps made by the same manufacturer with the same materials. Thus, an optimal preheat duration for one lamp may significantly shorten the life, or reliability of another similar lamp. Further, as a gas discharge lamp ages, the optimal preheat duration may vary, and may vary differently among different lamps. Accordingly, there is a need for a starter with a lamp specific preheat duration that is customized to the particular gas discharge light source used with the starter, even when the gas discharge light source was previously not known or tested to optimize operation with the starter.

SUMMARY

A gas discharge light source and a starter to control startup are operated with a ballast. The starter is configured to customize the duration of a preheat cycle for the particular gas discharge light source being energized by the ballast. Customization of the preheat cycle is performed by the starter based on a filament resistance that is calculated by the starter when the gas discharge light source is first energized by the ballast.

The starter may include a current sensor to measure a magnitude of current supplied from the ballast to the gas discharge light source. The starter may also include voltage sensing capability to measure a magnitude of voltage across one or more of the filaments included in the gas discharge light source. When the gas discharge light source is initially energized, the starter may calculate a "cold" filament resistance (rcold) value of one or more of the filaments based on the measured voltage and current. The duration of the preheat cycle administered by the starter may be based on the calculated rcold value.

The starter may also include a switch. The switch may be coupled between first and second cathodes, or filaments, included in the gas discharge light source. When the switch is closed, the first and second filaments may be hardwired in series with each other and with the ballast. When the ballast supplies power, the starter may measure voltage and current and calculate the rcold value for the particular gas discharge light source. In addition, the starter may maintain the switch in the closed position to preheat the first and second filaments. Based on the calculated rcold value, the starter may calculate a target "hot" filament resistance (rhot) value for the gas discharge light source. The calculated target rhot value may be based on a temperature of the filaments that is desired at the conclusion of the preheat cycle. During the preheat cycle, the switch remains closed, and the starter iteratively calculates a measured filament resistance (rmeas). When the measured filament resistance (rmeas) reaches the calculated target rhot value, the duration of the preheat cycle may be completed, and the starter may open the switch.

Using a calculated rcold value and a calculated rhot value that are specific to a particular gas discharge light source, the starter can select a customized duration of the preheat cycle to maximize longevity of the life of the gas discharge light source, and to optimize startup and operational reliability of the gas discharge light source. In addition, the starter may provide a diagnostic function to identify operational and/or mechanical issues related to the gas discharge light source. Further, the starter may automatically compensate for changes in the particular characteristics of a gas discharge light source by adjustment of the duration of the preheat cycle.

Other systems, methods, features and advantages of the invention will be, or will become, apparent to one with skill in the art upon examination of the following figures and detailed description. It is intended that all such additional systems, methods, features and advantages be included within this description, be within the scope of the invention, and be protected by the following claims.

BRIEF DESCRIPTION OF THE DRAWINGS

The invention may be better understood with reference to the following drawings and description. The components in the figures are not necessarily to scale, emphasis instead being placed upon illustrating the principles of the invention. Moreover, in the figures, like referenced numerals designate corresponding parts throughout the different views.

DETAILED DESCRIPTION OF THE PREFERRED EMBODIMENTS

A starter for a gas discharge light source, such as a fluorescent lamp, is capable of optimizing operation of a particular gas discharge light source being started with the starter. In addition, the starter is capable of adjusting operation during the life of the gas discharge light source as the characteristics of the particular individual gas discharge light source change. The starter is also capable of being operated with any current limiting device, such as a ballast, and can monitor operational parameters of the gas discharge light source following startup.

Figure 1:
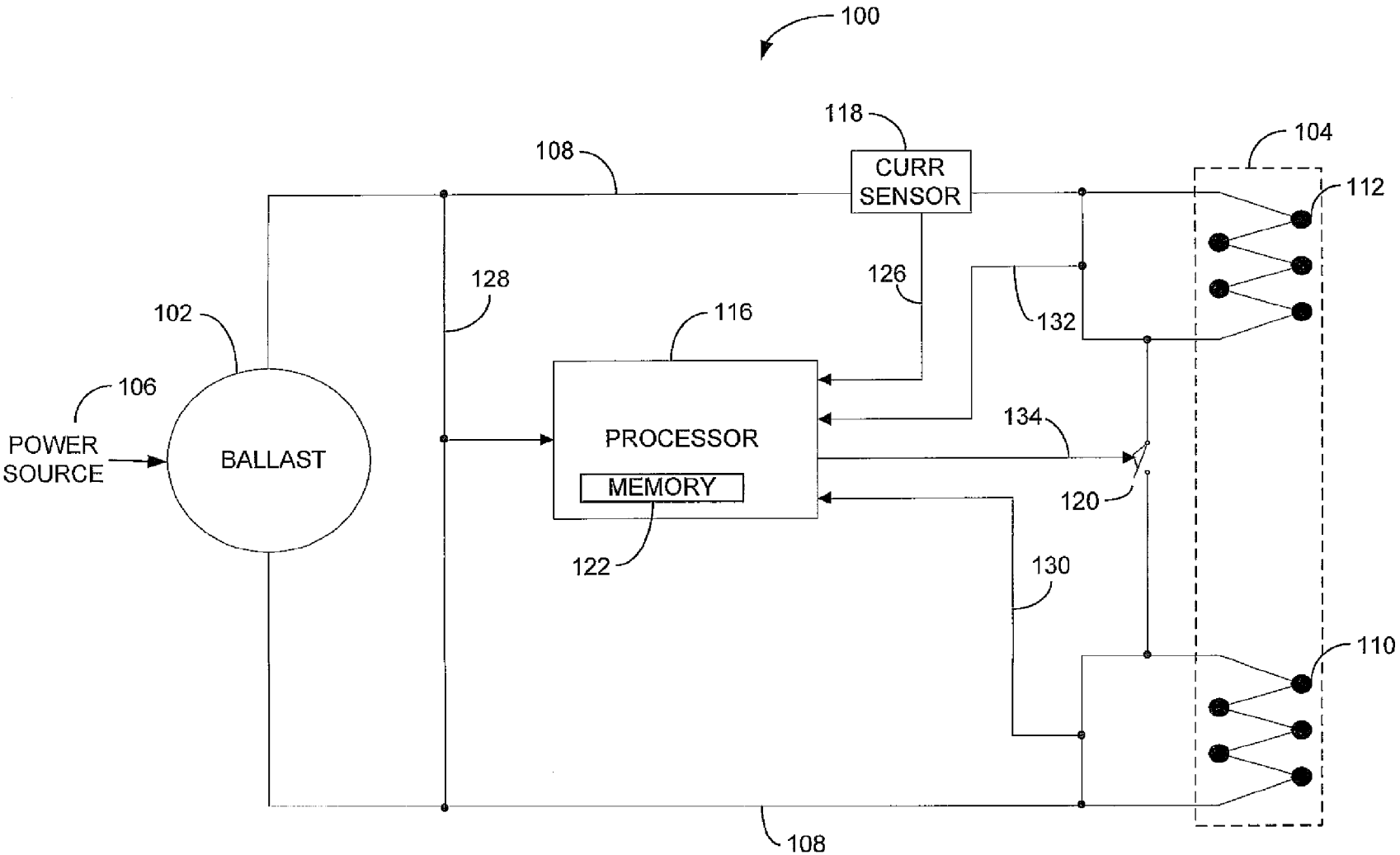
FIG. 1 is a block diagram of a starter coupled with a ballast and a gas discharge light source.

FIG. 1 is a block diagram of an example starter 100 coupled with a ballast 102, and a gas discharge light source 104. A power source 106 may be coupled with the ballast 102 to provide electric power to the starter 100 and the gas discharge light source 104 via a power supply line 108. The power source 106 may be an electric utility, a generator, etc. The ballast 102 may be an analog and/or digital ballast, a magnetic ballast, or any other mechanism(s) configured to regulate current supplied to the gas discharge light source 104.

The gas discharge light source 104 may be a fluorescent lamp, a neon lamp, a sodium vapor lamp, a xenon flash lamp, or any other form of artificial light source(s) that generates visible light by flowing an electric current through a gas. The gas discharge light source 104 may include a first filament 110 and a second filament 112 disposed in the gas. The first and second filaments 110 and 112 may be any form of cathode. Accordingly, in some examples, both the first and second filaments 110 and 112 may be electrical filaments formed with metal that may give off electrons when heated. In other examples, the first filament 110 may be an electrical filament formed with metal that gives of electrons when heated, and the second filament 112 may be some other form of current conducting material. The gas discharge light source 104 may include a housing in which the starter 100 is disposed. The housing may form at least a portion of the gas discharge light source 14. Accordingly, the gas discharge light source 104 and the starter 100 may be an integrally formed unit. Alternatively, the starter 100 may be a replaceable component included in the housing of the gas discharge light source 104. In still another alternative, the starter 100 may be external to, and separable from, the gas discharge light source 104. In this example, the starter 100 may be directly or indirectly coupled with the gas discharge light source 104.

The starter 100 depicted in FIG. 1 includes a processor 116, a current sensor 118, and a switch 120. The processor 116 may be, for example, a microprocessor, an electronic control unit or any other device capable of executing instructions and/or logic, monitoring electrical inputs and providing electrical outputs. The processor 116 may perform calculations, operations and other logic related tasks to operate the starter 100. The processor 116 may operate as a function of a software configuration comprising instructions. The software configuration may be firmware, software applications and/or logic stored in a memory 122 coupled with the processor 116. The processor 116 and the memory 122 may cooperatively operate to form a central processing unit (CPU) for the starter 100. Accordingly, the processor 116 may execute instructions stored in the memory 122 to provide the functionality described herein.

The memory 122 may be any combination of volatile and non-volatile memory, such as for example a magnetic media and a flash memory or other similar data storage devices in communication with the processor 116. The memory 122 may store the electrical parameters measured and/or derived by the processor 116 during operation. The memory 122 may also store a software configuration of the starter 100. In addition, the memory 122 may be used to store other information pertaining to the functionality or operation of the starter 100, such as predetermined operational parameters, service records, etc. The memory 116 may be internal and/or external to the processor 116.

During operation, the starter 100 may monitor the current supplied to the gas discharged light source 104 on the power supply line 108 using the current sensor 118. The current sensor 118 may be any form of circuit or device capable of providing a signal output indicative of a sensed current. In one example, the current sensor 118 includes a shunt resistor. The current sensor 118 includes functionality to measure the voltage drop across the shunt resistor and convert the measured voltage to a current that is indicative of the current supplied to the gas discharge light source 104. The current signal output by the current sensor 118 may be provided to the processor 116 as a signal input on a current sensing line 126.

The processor 116 may also receive a lamp voltage indication signal on a lamp voltage line 128. The lamp voltage indication may represent a magnitude of voltage supplied by the power source 106 via the ballast 102 to the gas discharge light source 104. In the example of FIG. 1, the lamp voltage line 128 is directly coupled with the processor 116. In other examples, a transducer, such as a step up or step down transformer, a shunt, of any other circuit or mechanism may be included to adjust the magnitude of the lamp voltage indication signal to be compatible with an input of the processor 116. Alternatively, or in addition, filtering, or any other form of voltage/signal conditioning may be may be included in the lamp voltage line 128 to condition and/or transform the lamp voltage to be compatible with the input of the processor 116.

The processor 116 may also receive a first filament voltage signal on a first filament voltage line 130, and a second filament voltage signal on a second filament voltage line 132. Similar to the lamp voltage line 128, the first and second filament voltage lines 130 and 132 may included transducers, filtering, etc., to condition and/or transform the respective filament voltages to be compatible with input capability of the processor 116.

The switch 120 may be controlled by an output signal from the processor 116 on a switch control line 134. The switch 120 may be toggled by the processor 116 between an open and a closed position as described later. The switch 120 may be coupled between the first filament 110 and the second filament 112. Accordingly, when closed, the switch 120 provides a hard wired series connection between the first filament 110 and the second filament 112. The switch 120 may be one or more semiconductors, silicon controlled rectifiers (SCRs), reed switches, relays, and/or any other circuit or mechanism capable of being toggled between a conducting and a non-conducting state as directed by the processor 116.

During operation, when the ballast 102 is initially energized by the power source 106, the processor 116 may toggle the switch 120 to a closed position. Thus, the first and second filaments 110 and 112 may be hardwired in series with the power source 106 via the ballast 102. In addition, the processor 116 may calculate a "cold" filament resistance value (rcold) for the particular gas discharge light source 104 that is coupled with the starter 104. Calculation of rcold may be based on the current measured by the current sensor 118, and a measured voltage of at least one of the first and second filaments 110 and 112.

The processor 116 may calculate the gas discharge light source specific "cold" filament resistance value (rcold) for each of the first and second filaments 110 and 112. Alternatively, or in addition, the voltages or calculated gas discharge light source specific rcold values may be averaged. In one example, the power source 106 is an alternating current (AC) power source, and the processor 116 may calculate rcold by sampling the voltage and current at a determined sample rate, and converting the voltage and current to root mean squared (RMS) values. The determined sample rate may be a value stored in the memory 122 that is accessed by the processor 116. In one example, the sample rate may be greater than the frequency of the power source 106. In another example, the sample rate may be greater than about twice the frequency of the power source 106. In another example, the voltage and current may be processed through respective analog filters, and the filtered signals may be provided to the processor 116. The filtered signals provide by the analog filters may be proportional to the voltage and current and representative of the average voltage and current received by the analog filters.

Due to variations in materials and manufacturing, the calculated rcold value of a particular gas discharge light source 104 can vary widely, even among similarly manufactured light sources. In addition, as a gas discharge light source ages, the properties of the filaments and other materials may change causing non-uniform and unpredictable variation in the calculated rcold value of an individual gas discharge light source 104. Accordingly, determination of a gas discharge light source specific "cold" filament resistance (rcold) value may customize the starter 100 to optimize operation of the particular gas discharge light source 104 coupled therewith. Using the calculated rcold value, the first and second filaments 110 and 112 may be preheated for a period of time that is determined based on the calculated rcold value. The duration of the preheat cycle may be the period of time that the first and second filaments 110 and 112 are coupled in series with the power source 106 to allow the temperature of the first and second filaments 110 and 112 to increase to a desired temperature.

As the first and second filaments 110 and 112 are heated, free electrons may be given off into the gas present in the gas discharge light source 104. These charged particles reduce the resistance of a current path through the gas. When the temperature of the first and second filaments 110 and 112 have reached the optimum temperature to strike an arc in the gas discharge lamp, the processor 116 directs the switch 120 to open.

Since the first and second filaments 110 and 112 are no longer in series with the power source 106, a voltage difference develops between the first and second filaments 110 and 112. Due to the voltage difference, and the free electrons providing a low resistance path, an electrical arc is struck between the first and second filaments 110 and 112 ionizing the gas. The ionized gas forms a plasma that provides a current path between the first and second filaments 110 and 112 resulting in the emission of light waves. Accordingly, once the plasma is formed, the first and second filaments 110 and 112 are coupled in series with each other and the power source 106 via the plasma.

Optimizing the temperature at which a specific gas discharge light source 104 is transitioned from the preheat cycle to continued operation as a source of light can maximize the life of that particular gas discharge light source 104. In addition, the startup time of the gas discharge light source 104 can be optimized. Further, the reliability and repeatability of successfully striking an arc to light the gas discharge light source at the conclusion of the preheat cycle may be maximized. Since a hotter preheat tends to increase reliability and provide "instant" on capability, at the expense of longevity of the lamp, and a cooler preheat extends the life of the lamp, but tends to lower reliability of starting and increases startup time, there is a balance between increased longevity and reliability. A balance that enables optimization of the operation of the lamp can be achieved by customizing an arc temperature point achieved during the preheat cycle to be optimal for a particular individual gas discharge light source 104.

Optimizing the arc temperature point at which a specific gas discharge light source 104 is transitioned may be based on the measured and calculated specific rcold value and a "hot" filament resistance value (rhot) calculated by the processor 116. A calculated gas discharge light source specific "hot" filament resistance value (rhot) may be determined based on the calculated specific rcold value, and a characteristic ratio of rcold to rhot for a particular filament material included in the light source 104, and the particular type of gas discharge light source 104 coupled with the starter 100.

Figure 2:
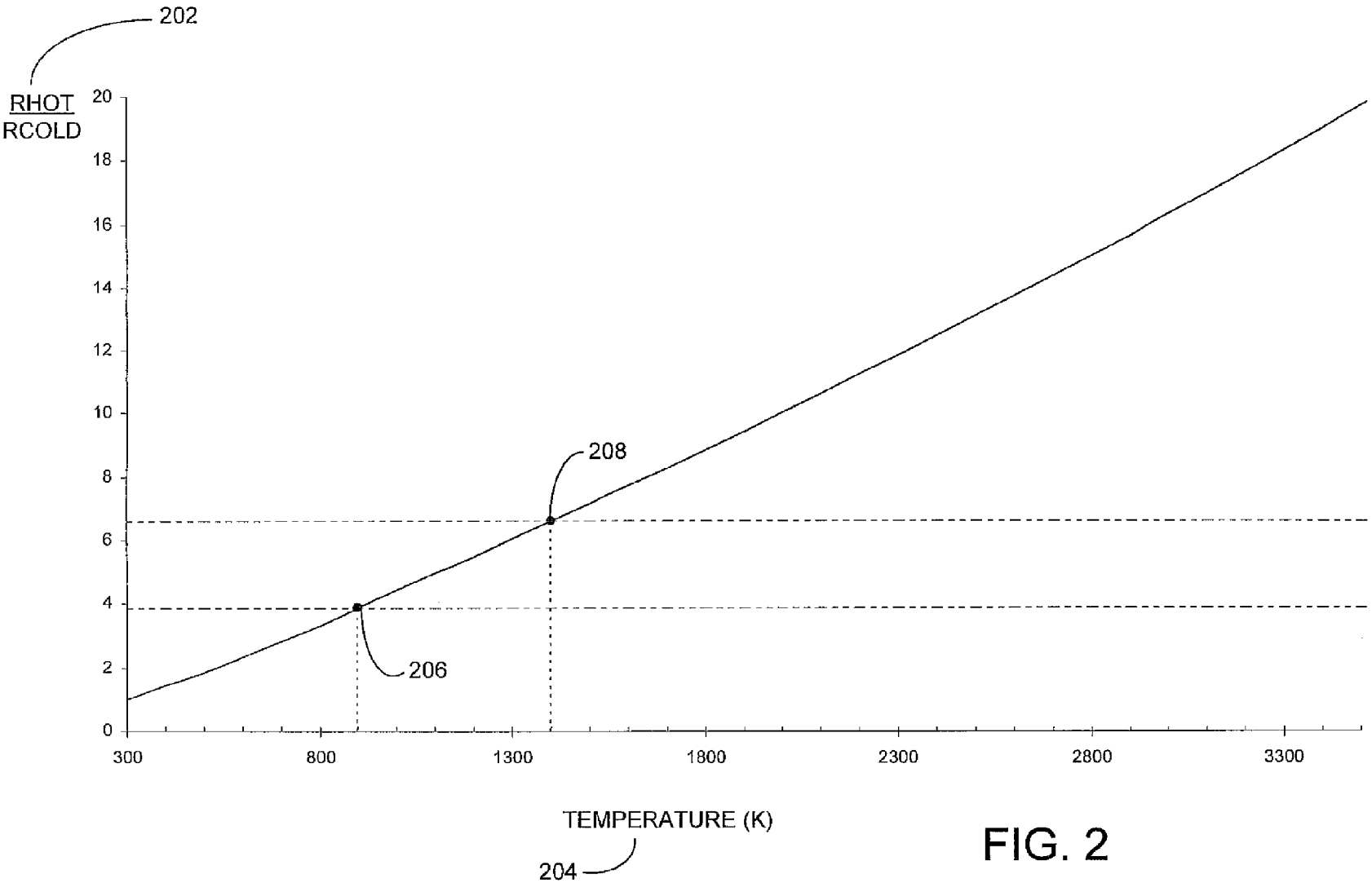
FIG. 2 is a graph of rhot/rcold vs. temperature.

FIG. 2 is a graph depicting an example lamp resistance ratio of rhot to rcold versus temperature for an example filament material of tungsten. This characteristic ratio information may be stored in memory 122 (FIG. 1) as a table, a graph, or data. In FIG. 2, the lamp resistance ratio of rhot to rcold 202 is depicted along the y-axis, and a temperature range 204 from about 300 Kelvins to about 3500 Kelvins is depicted along the x-axis. As depicted in FIG. 2, for this example, as the temperature increases, the ratio increases. In the illustrated example, the filament material tungsten is for use in a type of gas discharge light source that is a low pressure mercury lamp. Similar to other gas discharge light sources, in a low pressure mercury lamp, the filaments are typically preheated to a determined temperature, or range of temperature, that is a strike temperature. When the determined temperature (or temperature range) is reached, an arc is struck between the filaments, as previously discussed, and the lamp is illuminated. In a low pressure mercury lamp, the strike temperature is in a range between about 900 Kelvins and about 1400 Kelvins.

In the example of FIG. 2, at a minimum arc strike point 206 of about 900 Kelvins, the lamp resistance ratio of rhot to rcold is about 4.0, and at a maximum arc strike point 208 of about 1400 Kelvins, the lamp resistance ratio of rhot to rcold is about 6.5. Thus, a range of the lamp resistance ratio of rhot to rcold within which an arc can be struck is provided. In other examples, other minimum and maximum arc strike point temperatures may be used. In addition, in other examples, different filament materials, and/or different types of light sources may be used to create the characteristic ratio information and/or determine the lamp resistance ratio range.

As previously discussed, a gas discharge light source specific "cold" filament resistance (rcold) value is calculated based on the voltage and current when the gas discharge light source is initially energized and begins preheating. Based on the graph of FIG. 2 and the calculated light source specific rcold value, a light source specific "hot" filament resistance value (rhot) may be calculated by:

$$rhot = \frac{\text{ratio}(rhot/rcold)}{rcold(meas)} \qquad \text{Equation 1}$$

where the ratio rhot/rcold is a lamp resistance ratio at a determined temperature that can be obtained from a graph, such as FIG. 2, and the rcold(meas) is the calculated gas discharge light source specific rcold value. For example, the lamp resistance ratio could be 4.2, and the rcold(meas) could be five ohms based on a voltage and current measure at a temperature of 300 Kelvins. Thus, a light source specific target "hot" filament resistance value (rhot target) may be calculated and used to accurately determine, based on the operational characteristics that are specific to the particular light source, when the preheat cycle should end.

Referring again to FIG. 1, in one example, the desired arc strike temperature may be pre-selected and stored in memory 122. In another example, a calculated rhot target can be initially established based on the minimum arc strike temperature and stored in memory 122. If, the rhot target is reached during the preheat cycle, but an arc cannot be struck, the rhot target may be increased by increasing the desired arc strike temperature by a determined amount, which also may be stored in the memory 122. For example, an initial rhot target may be based on the minimum arc strike point 206 of about 1000 Kelvins, and then increased incrementally each time an arc is not struck until the rhot target is based on the maximum arc strike temperature 208 of about 3500 Kelvin.

The duration of the preheat cycle may be automatically adjusted by the processor 116. As previously discussed, calculated rhot target may be adjusted automatically by the processor 116 to adjust the preheat temperature if the calculated light source specific "hot" filament resistance (rhot) value is reached but the light source does not light when the switch 120 is opened. Specifically, the processor 116 may adjust the preheat time by automatically adjusting the lamp resistance ratio within a determined range. For example, where the range of the lamp resistance ratio where an arc can be struck for a particular gas discharge light source is between about 4.0 and about 6.5, the lamp resistance ratio of about 4.0 may be used initially to calculate the light source specific target "hot" filament resistance value (rhot). However, when the lamp fails to light, the processor may automatically use about 5.0 and then about 6.0, for example, as the lamp resistance ratio (if needed) to get the gas discharge light source 104 to strike an arc and light.

In addition to optimizing lamp life and optimizing startup time, calculation of lamp specific rhot and rcold values may also be used as a diagnostic tool. For example, if the calculated rcold value changes suddenly, or is outside a predetermined range based on material and/or manufacturing variables, the processor 116 may generate an alarm, or disable further starts of the gas discharge light source. Alternatively, or in addition, if the duration of the preheat cycle to reach the calculated light source specific target "hot" filament resistance (rhot) value is greater than a predetermined time, the processor 116 may alarm or disable further starts of the gas discharge light source 104.

In one example scenario, the processor 116 may determine the calculated lamp specific rcold value is outside the range and alarm that the lamp is damaged, or that the wrong lamp is installed. In another example scenario, such as in the case of gas discharge light source for use in a tanning bed, the processor 116 may calculate the lamp specific rcold value and then calculate the lamp specific rhot value. If the calculated lamp specific rhot value is outside a predetermined range, the processor 116 may leave the gas discharge light source in preheat mode until the filaments 110 and 112 in the light source 104 burn up, forcing replacement of weak bulbs in the tanning bed based on predetermined minimum required output of the bulbs.

Since the starter 100 may be automatically "tuned" for operation with any gas discharge light source 104 by calculating a light source specific rcold, the starter 100 may be used with any ballast 102 or light source 104. Accordingly, since no component matching is needed, the starter 100 may be a stand alone productized component, and/or may be productized as a component included in a light source and/or ballast. Also, the climate, such as temperature, within which the light source 104 is used can be automatically compensated for by the starter 100.

Figure 3:
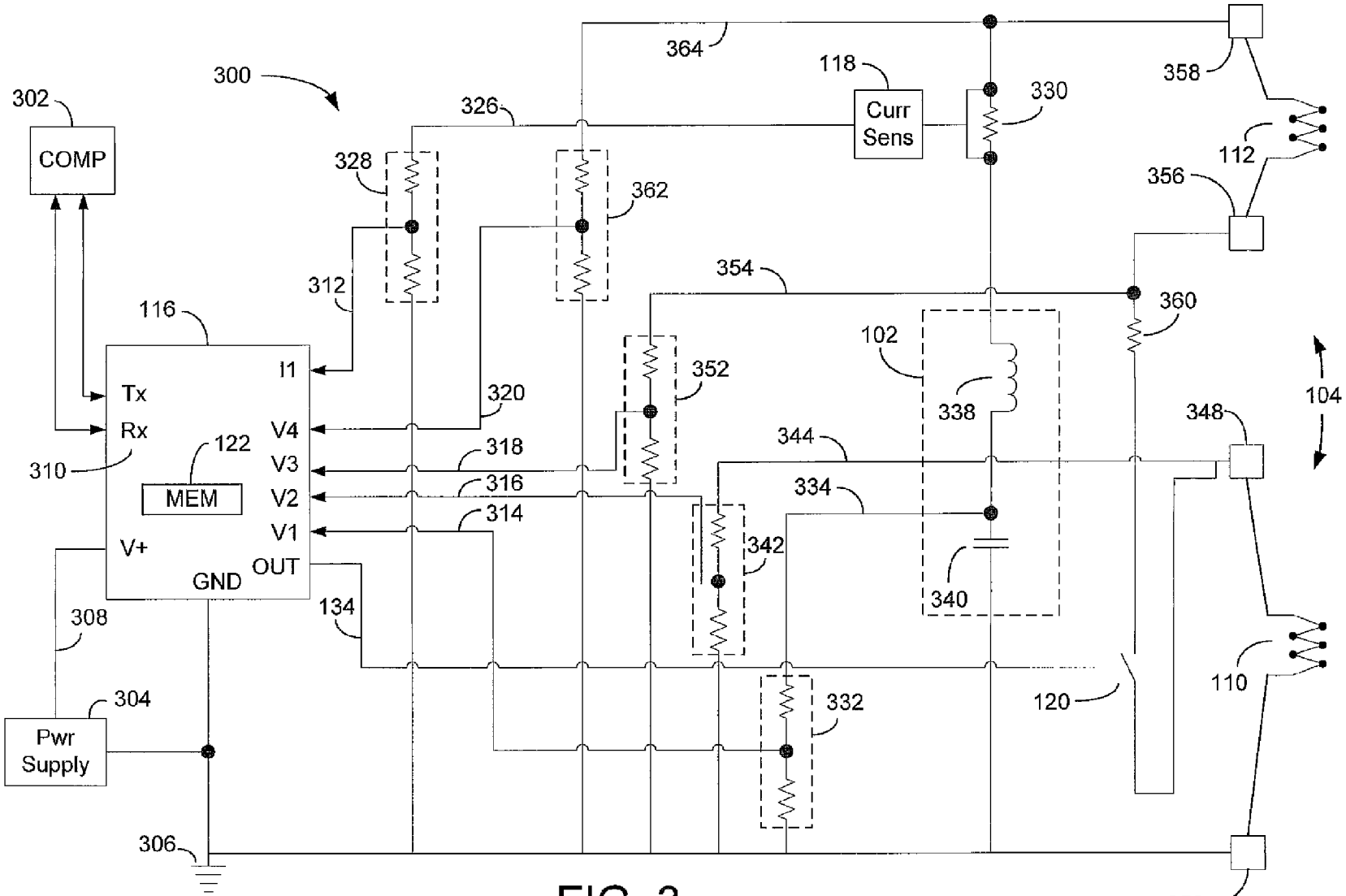
FIG. 3 is another block diagram of a starter coupled with a ballast and a gas discharge light source.

FIG. 3 is a circuit schematic of an example starter 300. An example computer 302, power supply 304, and gas discharge light source 104 are also illustrated. The computer 302 may be one or more of a personal computer, a lap top computer, a personal digital assistant (PDA), a server, or any other device (s) capable of executing instructions and communicating data. In addition, the computer 302 can include a network, such as a wireless or wired network, and associated devices.

The power supply 304 may be a DC supply capable of converting alternating current (AC) to direct current (DC). Alternatively, the power supply 304 may be an AC supply, a power conditioner, an uninterruptable power source, a battery, a solar panel, and/or any other mechanism or device capable of supplying power to the starter 300. The power supply 304 may be regulated or unregulated, and may include an internal power source, such as a battery, a solar panel, a charging capacitor, etc. The power supply 304 may be coupled with a ground connection 306, and provide DC power to the processor 116 on a voltage supply line 308. The processor 116 may also be coupled with the ground connection 306.

The processor 116 includes a communication port 310 that enables communication with the computer 302. Communication may be serial and/or digital, and may occur via TCPIP, RS232, or any other form of communication format and/or protocol. Communication may be wireless and/or wireline, and may be over a dedicated communication path, or over a network. The communication port 310 may be used to communicate commands and/or data between the processor 116 and the computer 302.

In one example, the computer 302 may be used to download data to the processor 116 such as lamp resistance ratio vs. temperature graph data, a maximum preheat time, a range of a calculated lamp specific rcold value, or any other predetermined or determined values, etc, via the communication port 310. Alternatively, or in addition, the computer 302 may be used to capture and store measured values, operational parameters, or any other data uploaded from the processor 116 via the communication port 310. The computer 302 may also be configured to perform computer related functionality, such as, network access, application execution, data manipulation, etc., using a user interface that can includes a graphical user interface (GUI), keyboard, pointing selection device, etc. Accordingly, data transfer and storage, data analysis, data manipulation, etc. may be performed with the computer 302.

The processor 116 may execute instructions stored on a computer readable medium, as previously discussed, to receive and process input signals and generate and transmit output signals. The processor 116 includes a plurality of inputs and outputs (I/O) that may include digital signals and/or analog signals. The digital and analog signals may be voltage signals and/or current signals. In FIG. 3, the processor 116 includes a plurality of analog voltage inputs that comprise a current input (I1) on a current input line 312, a first voltage input (V1) on a first voltage input line 314, a second voltage input (V2) on a second voltage input line 316, a third voltage (V3) on a third voltage input line 318, and a fourth voltage (V4) on a fourth voltage input line 320. The processor 300 of FIG. 3 also includes a digital output that is a switch control output provided on the switch control line 134. In other examples, the processor 116 may include any number of analog and/or digital I/O.

The current input line 312 also may be coupled with the current sensor 118 via a current line 326, which is also coupled with the ground connection 306. The current line 326 includes a plurality of resistors 328 configured to scale an output signal of the current sensor 118. In FIG. 3, the current sensor 118 generates a current output signal on the current line 326 based on a variable voltage drop across a current resistor 330. The current resistor 330 is subject to the current and voltage supplied to the gas discharge light source 104 via the ballast 102. The current output signal may be received by the resistors 328 and converted to a voltage range, such as 0-5 volts. In other examples, the current sensor 118 may provide an output signal that can be directly received by the processor 116. In still other examples, the processor 116 may be capable of sensing the current or the voltage across the current resistor 330 directly, and the current sensor 118 may be omitted.

The first voltage input line 314 may be coupled with a plurality of scaling resistors 332 included in a ballast line 334. The ballast line 334 may be coupled with the ballast 102 and the ground connection 306. The scaling resistors 332 may scale a voltage of the ballast 102 to a range compatible with the first input voltage (V1) of the processor 116. Alternatively, the ballast voltage could be received directly by the processor 116, and the scaling resistors 332 may be omitted.

In FIG. 3, the ballast 102 includes an inductor 338 and a capacitor 340. The inductor 338 is coupled between the current resistor 330 and the capacitor 340. The capacitor 340 is coupled between the inductor 330 and the ground connection 306. In other examples, the ballast 102 may include any other circuits and/or devices to provide ballast functionality. In FIG. 3, the ballast line 334 is coupled between the inductor 338 and the capacitor 340. Accordingly, during operation, the ballast line 334 carries a voltage indicative of the voltage stored in the capacitor 340.

The second voltage input line 316 is coupled with a plurality of scaling resistors 342 included in a first filament voltage line 344. The first filament voltage line 344 is coupled with the ground connection 306 and a first filament pin 348 coupled with a first filament 110 included in the gas discharge light source 104. The first filament 110 is also coupled with the ground connection 306 via a second filament pin 350.

The third voltage input line 318 is coupled with a plurality of scaling resistors 352 included in a second filament voltage line 354. The second filament voltage line 354 is coupled with the ground connection 306 and a third filament pin 356. The third filament pin 356 is coupled with one end of a second filament 112 included in the gas discharge light source 104, and a fourth filament pin 358 is connected with the other end of the second filament 112. Thus, the voltage across the second filament 112 may be sensed via the third filament pin 356 and the fourth filament pin 358. The scaling resistors 352 may be omitted when the processor 116 is capable of directly receiving the voltage sensed at the third filament pin 356.

The third filament pin 356 is also coupled with the first filament pin 348 via the switch 120 and a current limiting resistor 360. Accordingly, when the switch 120 is closed, the first and second filaments 110 and 112 are coupled in series via the first and third filament pins 348 and 356, and the current is limited by the current limiting resistor 360. In other examples, current limiting is unnecessary and the current limiting resistor 360 may be omitted. The switch 120 is opened and closed via digital output signal (Out) generated by the processor 116 on the switch control line 134. The switch 120 is operated by the processor 116 to toggle between a preheat mode (closed) and an operation mode (open) as previously discussed.

The fourth voltage input line 320 is coupled with a plurality of scale resistors 362 included in a third filament voltage line 364. The third filament voltage line 364 is coupled with the ground connection 306, the current resistor 330, and the fourth filament pin 358. Accordingly, a portion of the third filament voltage line 364 provides voltage and current from the ballast 102 to the gas discharge light source 104. Thus, the scale resistors 362 provide scaling of the voltage provided to the gas discharge light source 104. Alternatively, the scale resistors 362 may be omitted and the voltage may be supplied directly to the processor 116.

Figure 4:
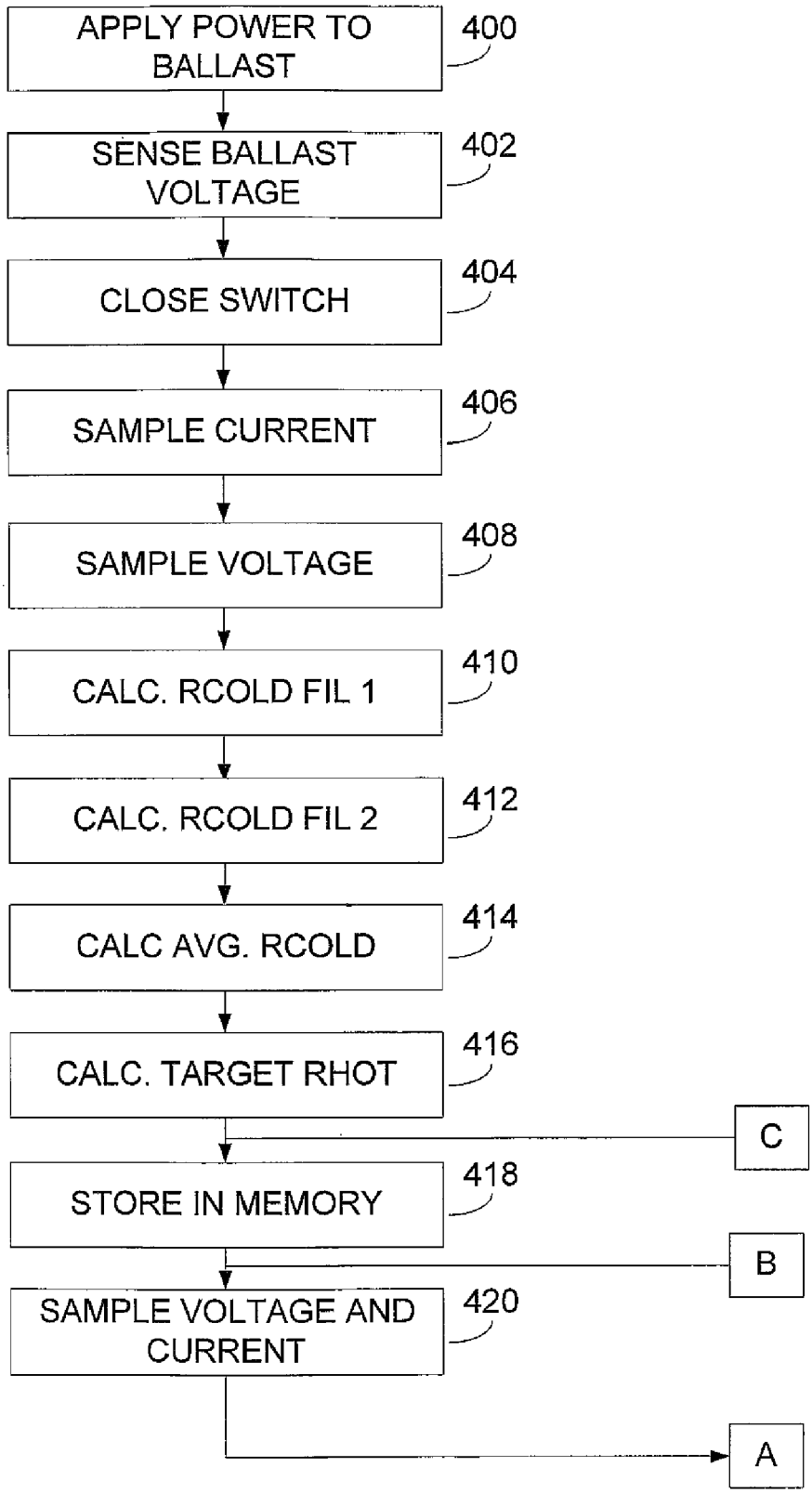
FIG. 4 is a first portion of an operational flow diagram of the starter and a gas discharge light source of FIG. 3.
Figure 5:
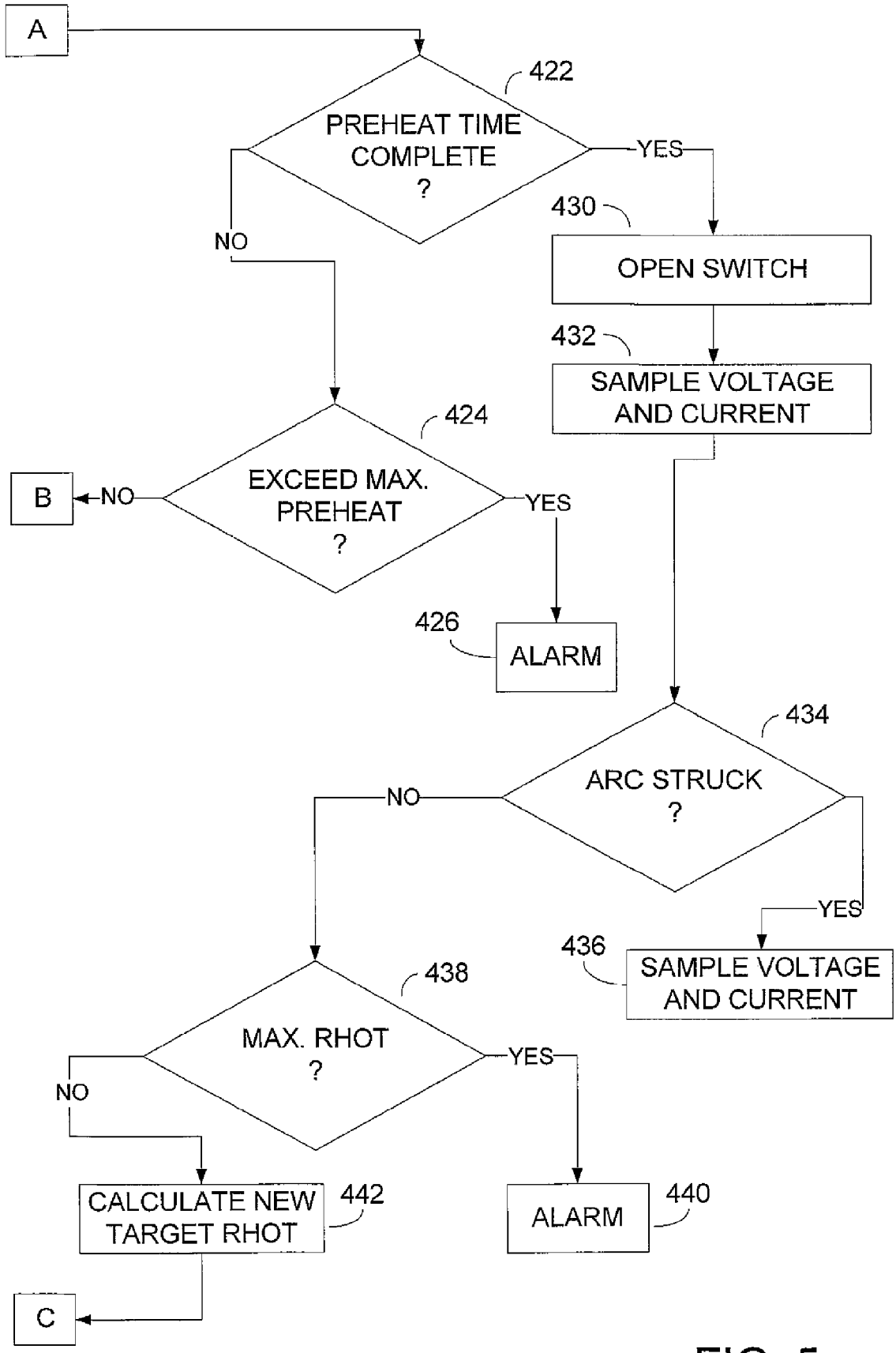
FIG. 5 is a second portion of an operational flow diagram of the starter and gas discharge light source of FIG. 3.

FIG. 4 is an operational block diagram describing example operation of the starter 300, ballast 102 and gas discharge light source 104 depicted in FIG. 3. At block 400, power is applied to the ballast 104. The processor 116 senses the voltage in the ballast 104 on the first voltage input line 314 at block 402. At block 404, the processor 116 may close the switch 120 via the switch control line 134. Alternatively, since the ballast 104 was not previously powered, the switch 120 may be in the closed position already. The processor 116 may also sample the current input signal (I1) being provided on the current input line 312 from the current sensor 118 at block 406. Also, the processor 116 may sample the second input voltage (V2) being provided on the second input voltage line 316, the third input voltage (V3) being provided on the third input voltage line 318 and the fourth input voltage (V4) being provided on the fourth input voltage line 320 at block 408.

As previously discussed, the second input voltage (V2) with respect to the ground connection 306 is representative of the voltage across the first filament 110. Using the input current (I1) and the voltage (V2) across the first filament 110, the processor 116 calculates the cold resistance of the first filament 110 (rcoldfil1) as:

$$rcoldfil1 = \frac{secondinputvoltage(V2)}{measuredcurrent(I1)} \qquad \text{Equation 2}$$

at block 410. At block 412, the input current (I1) and the third and fourth input voltages (V3 and V4) are used by the processor 116 to calculate the cold resistance of the second filament 112 (rcoldfil2) as:

$$rcoldfil2 = \frac{fourthinputvoltage(V4) - thirdinputvoltage(V3)}{measuredcurrent(I1)}. \qquad \text{Equation 3}$$

The processor 116 may sample the input current (I1) and first, second and third voltages (V2, V3, and V4) at the predetermined sample rate and integrate the sample values to obtain RMS values.

An average cold resistance (rcoldavg) or (rcold) for the specific gas discharge light source 104 may be determined by the processor 116 by:

$$rcoldavg = \frac{rcoldfil1 + rcoldfil2}{2} \qquad \text{Equation 4}$$

at block 414. Alternatively, the cold resistance of the first filament 110 and the cold resistance of the second filament 112 may be used separately. At block 416, based on the calculated rcold average that is specific to the gas discharge light source 104, the processor 116 calculates a target rhot. The calculated target rhot is specific to the gas discharge light source 104, and may be determined from Equation 1 based on a determined preheat temperature and ratio characteristic information stored in memory, such as the example ratio characteristic information illustrated in FIG. 2, from which a lamp resistance ratio (rhot/rcold) is determined. Alternatively, a target rhot may be calculated separately for each of the first filament 110 and the second filament 112. The one or more calculated gas discharge light source specific target rhot is stored in memory at block 418.

At block 420, the processor 116 samples the current (I1) and the second, third and fourth voltages (V2, V3 and V4), and may calculate an average measured filament resistance (rmeas) of the specific gas discharge light source 104. As previously discussed, the current and voltages may be sampled at a predetermined sample rate and integrated to obtain RMS values. Based on the calculated average measured filament resistance (rmeas), the processor 116 determines if the duration of the preheat cycle is complete at block 422. If the time for the preheat cycle is not complete, the processor 116 determines if the preheat time has exceeded the predetermined maximum preheat time at block 424. If the maximum preheat time has not been exceeded, the processor 116 returns to block 420 and repeats sampling, etc.

In another example, the processor 116 may samples the current (I1) and the second, third and fourth voltages (V2, V3 and V4), and calculate a filament resistance (rmeas) for each of the first and second filaments 110 and 112. In this example, the calculated filament resistances (rmeas) are compared to respective calculated target rhot values for each of the respective first and second filaments 110 and 112. The processor 116 may conclude the duration of the preheat time when the calculated filament resistances (rmeas) of both the first and second filaments 110 and 112 exceed respective calculated target rhot values. Alternatively, the processor 116 may conclude the duration of the preheat time when either one of the calculated filament resistances (rmeas) exceed the respective calculated target rhot values.

If the predetermined maximum preheat time has been exceeded at block 424, the processor 116 may generate an alarm at block 426. Alternatively, or in addition, the processor 116 may disable the starter 300, set a flag to disable additional starts, and/or continue preheating until the filaments 110 and 112 are melted as previously discussed. In another example, the processor 116 may open the switch 120 to conclude the preheat cycle when the predetermined maximum preheat time is reached in an attempt to strike the arc even if the calculated target rhot has not yet been reached. Accordingly, the processor 116 in this example will allow the duration of the preheat cycle to continue until, either the average measured filament resistance (rmeas) reaches the gas discharge light source specific target rhot as calculated by the processor 116, or the duration of the preheat cycle exceeds a determined time, whichever occurs first. If the preheat cycle exceeds the determined time, and the arc is not successfully struck when the preheat cycle is concluded, the processor 116 may recalculate the rhot target with a higher desired strike temperature, as previously discussed, and return to block 420 to commence with the preheat cycle.

If, at block 422, the determined preheat time has been reached (rmeas is substantially the same as the calculated target rhot), the processor 116 directs the switch 120 to open at block 430. At block 432, the processor 116 samples the voltage and current inputs while the switch 120 is open. At block 434, the processor 116 determines if the arc has been struck based on the current and voltage samples. If the arc has been struck, the processor 116 continues sampling and collecting operating data at block 436. If the arc was not struck, the processor 116 determines if a maximum rhot value has been reached at block 438. The maximum rhot value may be calculated from Equation 1 based on a lamp resistance ratio determined with the maximum arc strike point temperature. If the maximum rhot value has been reached, the processor 116 generates an alarm at block 440. Alternatively, or in addition, the processor 116 also may disable the starter 300, set a flag to disable additional starts, or continue preheating until the filaments 110 and 112 are melted, as previously discussed. If at block 438, it is determined by the processor 116 that the maximum rhot has not yet been reached, the processor 116 calculates a new target rhot at block 442 using a higher arc strike point temperature (lamp resistance ratio), and returns to block 418 to store the new target rhot, and again attempt to preheat the gas discharge light source 104.

The previously described starter is capable of automatically customizing the duration of the preheat cycle of a gas discharge light source to which the starter is coupled. Following entry of information identifying the type of gas discharge light source, and the type of filament thereof the starter may select a corresponding ratio resistance vs. temperature curve (characteristic ratio, information) from memory. Alternatively, the corresponding ratio resistance vs. temperature curve (characteristic ratio information) may be downloaded to the starter. In addition, a maximum preheat time may be entered and stored in memory, or downloaded to the starter.

Based on a measure voltage and current at the beginning of each preheat cycle, a gas discharge light source specific "cold" resistance value (rcold) may be calculated by the starter and used to determine a duration of the preheat cycle. The duration of the preheat cycle is automatically customized by the starter for the particular gas discharge light source coupled thereto. Thus, as the gas discharge light source changes over time, the starter can automatically adjust the duration of the preheat cycle based on the re-calculated rcold value. In addition, the duration of the preheat cycle is automatically optimized to provide reliability and longevity of the gas discharge light source. The starter may also perform a diagnostic function by confirming that the calculated rcold value is within an acceptable range, monitoring the duration of the preheat cycle, and determining whether the arc is successfully struck. Also, the starter is capable of multiple attempts to strike the arc with automatically adjusted corresponding durations of the preheat cycle when the arc is not successfully struck.

While various embodiments of the invention have been described, it will be apparent to those of ordinary skill in the art that many more embodiments and implementations are possible within the scope of the invention. Accordingly, the invention is not to be restricted except in light of the attached claims and their equivalents.

We claim:

1. A starter for a gas discharge light source comprising:

a current sensor configured to measure a current flow through a filament of a gas discharge light source; and a processor configured to be coupled with the current sensor and the filament, wherein the processor is operable to receive a current indication from the current sensor, and a voltage of the filament;

the processor operable to calculate a cold resistance value of the filament from the current indication and the voltage each time the gas discharge light source is first energized, wherein the processor is further operable to preheat the filament for a period of time that is determinable with the processor based on the calculated cold resistance.

2. The starter of claim 1, wherein the filament comprises first and second filaments, and the starter further comprises a switch coupled between the first and second filaments and with the processor, the switch controllable with the processor to be closed when the discharge light source is first energized to preheat the first and second filaments, and to be opened after a determined time based on the calculated cold resistance.

3. The starter of claim 2, wherein the first and second filaments are configured to be wired in series with each other and a power source when the switch is closed, and configured to be electrically coupled in series with the power source via plasma included in the discharge light source when the switch is opened.

4. The starter of claim 2, wherein the processor is further operable to calculate a hot filament resistance specific to the gas discharge light source based on the calculated cold resistance, and open the switch when the resistance of at least one of the first and second filaments is greater than or equal to the calculated hot filament resistance.

5. The starter of claim 4, wherein the processor is further operable to repeatedly calculate a measured resistance of at least one of the first and second filaments based on the current signal, and the voltage to preheat the filament for a period of time that is determinable based on the measured resistance becoming about equal to or greater than the calculated hot filament resistance.

6. The starter of claim 4, wherein the processor is operable to measure the time to reach the calculated hot filament resistance, and is further operable to provide indication when a determined time period to reach the calculated hot filament resistance is exceeded.

7. The starter of claim 1, wherein the starter is included inside a housing that forms at least a portion of the gas discharge light source.

8. The starter of claim 1, wherein the filament is suppliable with an alternating current power source, and the processor is operable to sample the voltage and current at a rate that is at least two times the frequency of the alternating current power source.

9. A method of starting a gas discharge light source, the method comprising:

energizing a gas discharge light source with a power source, wherein the gas discharge light source includes first and second filaments;

closing a switch to couple the first and second filaments in series with each other, and the power source;

calculating a cold resistance of at least one of the first and second filaments of the gas discharge light source each time the gas discharge light source is first energized;

preheating the first and second filaments with the power source for a period of time that is based on the calculated cold resistance; and opening the switch when the preheat is complete.

10. The method of claim 9, wherein calculating a cold resistance of at least one of the first and second filaments comprises measuring a voltage of at least one of the first and second filaments and a current through at least one of the first and second filaments, and calculating the cold resistance therefrom.

11. The method of claim 9, wherein preheating the first and second filaments comprises measuring a voltage of at least one of the first and second filaments and a current through at least one of the first and second filaments at a determined time interval as a temperature of the first and second filaments increases.

12. The method of claim 11, wherein the power source is an alternating current power source, and the determined time interval is greater than the frequency of the power source.

13. The method of claim 11, wherein measuring a voltage further comprises calculating a measured filament resistance of at least one of the first and second filaments based on the measured voltage and current.

14. The method of claim 13, wherein calculating a cold resistance further comprises calculating a gas discharge light source specific target hot filament resistance based on a predetermined lamp resistance ratio specific to the gas discharge light source and the calculated cold resistance.

15. The method of claim 14, wherein opening the switch comprises opening the switch when the measured filament resistance reaches or exceeds the calculated gas discharge light source specific target hot filament resistance.

16. The method of claim 9, further comprising striking an arc in the gas discharge light source when the switch is opened.

17. The method of claim 16, her comprising adjusting the period of time based on the calculated cold resistance when the arc fails to strike, closing the switch to preheat the first and second filaments with the power source for the adjusted period of time, and opening the switch again when the preheat is complete.

18. A starter for a gas discharge light source comprising:

a memory device configured to store a plurality of instructions executable with a processor;

instructions stored in the memory device to close a switch that hardwires first and second filaments included in a discharge light source in series with a power source;

instructions stored in the memory device to calculate a cold resistance of at least one of the first and second filaments each time the first and second filaments are first energized with the power source; and instructions stored in the memory device to open the switch after a period of time that is determined based on the calculated cold resistance.

19. The starter of claim 18, wherein the instructions to calculate a cold resistance comprises instructions stored in the memory device to sample a measured voltage of at least one of the first and second filaments and sample a measured current through at least one of the first and second filaments to calculate the cold resistance.

20. The starter of claim 18, further comprising instructions stored in the memory device to access characteristic ratio information stored in the memory device and calculate a hot resistance of at least one of the first and second filaments based on a predetermined desired strike temperature of at least one of the first and second filaments that is also stored in the memory device.

21. The starter of claim 20, further comprising instructions stored in the memory device to calculate a measured resistance of at least one of the first and second filaments based on a monitored current signal and a monitored voltage signal and to open the switch when the measured resistance equals or exceeds the calculated hot resistance.

22. The starter of claim 18, further comprising:

instructions stored in the memory device to re-close the switch if an arc is not struck when the switch is opened after the period of time;

instructions stored in the memory device to increase a predetermined desired strike temperature also stored in the memory device; and instructions stored in the memory device to re-open the switch after an extended period of time that is determined based on the calculated cold resistance and the increased predetermined desired strike temperature.

23. The starter of claim 18, further comprising instructions stored in the memory device to indicate when the switch is not opened within a predetermined period of time.

24. The starter of claim 18, further comprising instructions stored in the memory device to maintain the switch in the closed position to burn up the first and second filaments when the switch is not opened within a predetermined period of time.

25. The starter of claim 18, further comprising instructions stored in the memory device to disable operation of the starter when the switch is not opened within a predetermined period of time.

* * * * *

UNITED STATES PATENT AND TRADEMARK OFFICE

CERTIFICATE OF CORRECTION

PATENT NO. : 7,560,867 B2
APPLICATION NO. : 11/550216
DATED : July 14, 2009
INVENTOR(S) : Joshua Schwannecke et al.

It is certified that error appears in the above-identified patent and that said Letters Patent is hereby corrected as shown below:

In column 14, line 26, claim 17 please delete "her" and insert --further--.

Signed and Sealed this

Twenty-second Day of September, 2009

David J. Kappos

David J. Kappos
*Director of the United States Patent and Trademark Office*